US005460911A

United States Patent [19]

Yu et al.

[11] Patent Number: 5,460,911

[45] Date of Patent: Oct. 24, 1995

[54] ELECTROPHOTOGRAPHIC IMAGING MEMBER FREE OF REFLECTION INTERFERENCE

[75] Inventors: Robert C. U. Yu, Webster; Geoffrey M. T. Foley, Fairport; William G. Herbert, Williamson; William W. Limburg, Penfield; Satchidanand Mishia, Webster; Richard L. Post, Penfield; Neil S. Patterson, Pittsford; Donald C. VonHoene, Fairport, all of N.Y.

[73] Assignee: Xerox Corporation, Stamford, Conn.

[21] Appl. No.: 209,894

[22] Filed: Mar. 14, 1994

[51] Int. Cl.[6] ..... G03G 5/14

[52] U.S. Cl. ..... 430/64; 430/58

[58] Field of Search ..... 430/58, 59, 60, 430/63, 64

[56] References Cited

U.S. PATENT DOCUMENTS

| | | | |
|---|---|---|---|
| 4,618,552 | 10/1986 | Tanaka et al. | 430/60 |
| 5,051,328 | 9/1991 | Andrews et al. | 430/56 |
| 5,096,792 | 3/1992 | Simpson et al. | 430/58 |
| 5,139,907 | 8/1992 | Simpson et al. | 430/58 |
| 5,166,381 | 11/1992 | Teuscher et al. | 556/110 |
| 5,215,839 | 6/1993 | Yu | 430/58 |
| 5,238,763 | 8/1993 | Sullivan et al. | 430/63 |

FOREIGN PATENT DOCUMENTS

0462439A1 12/1991 European Pat. Off. .

*Primary Examiner*—John Goodrow

[57] ABSTRACT

An electrophotographic imaging member is disclosed comprising a substrate, a hole blocking, an optional interface adhesive layer, a charge generating layer, and a charge transport layer, the hole blocking layer comprising a light absorbing material selected from the group consisting of a dye, pigment and mixtures thereof dissolved or dispersed in a hole blocking matrix comprising a film forming polymer, the light absorbing material being capable of absorbing incident radiation having a wavelength between about 550 and about 950 nm. The dye or pigment may have a violet, blue, green, cyan or black color. These imaging members may be employed in an electrophotographic imaging process utilizing monochromatic activating radiation having a wavelength between a lower limit of 600 about and an upper limit of about 800 nm to form an electrostatic latent image on the imaging member.

20 Claims, 6 Drawing Sheets

ELECTROPHOTOGRAPHIC IMAGING MEMBER FREE OF REFLECTION INTERFERENCE

BACKGROUND INFORMATION

The present invention relates to an imaging system comprising an improved electrophotographic imaging member which exhibits reduced plywooding type defects in output prints when imaged with coherent light radiation.

Typical electrophotographic imaging members include photosensitive members or photoreceptors that are commonly utilized in electrophotographic or xerographic processes in either a flexible belt or a rigid drum configuration. The flexible belt may be seamless or seamed.

These electrophotographic imaging members comprise a photoconductive layer comprising a single layer or composite layers. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may still function as an anode when the charge transport layer is sandwiched between the supporting electrode and a photoconductive layer which is capable of photogenerating electrons and injecting the photogenerated electrons into the charge transport layer. The charge transport layer in this latter embodiment must be capable of supporting the injection of photogenerated electrons from the photoconductive layer and transporting the electrons through the charge transport layer.

Various combinations of materials from charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more diamine compounds. Various generating layers comprising photoconductive layers exhibiting the capability of photogeneration of holes and injection of the holes into a charge transport layer are well known in the art. The charge generation layer may be homogeneous photoconductive material or a dispersion of photoconductive particles dispersed in a film forming binder as disclosed, for example, in U.S. Pat. No. 4,265,990, the disclosure thereof being incorporated herein in its entirety. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper.

There are numerous applications in the electrophotographic art wherein a coherent beam of radiation, typically from a helium-neon or diode laser, is modulated by an input image data signal. The modulated beam is directed (scanned) across the surface of a photosensitive medium. The medium can be, for example, a photoreceptor drum or belt in a xerographic printer, a photosensor CCD array, or a photosensitive film. Certain classes of photosensitive medium which can be characterized as "layered photoreceptors" have at least a partially transparent photosensitive layer overlying a conductive ground plane. A problem inherent in using these layered photoreceptors, depending upon the physical characteristics, is an interference effectively created by two dominant reflections of the incident coherent light on the surface of the photoreceptor; e.g., a first reflection from the top surface and a second reflection from the bottom surface of the relatively opaque conductive ground plane. Spatial exposure variations present in the image formed on the photoreceptor becomes manifest in the output copy derived from the exposed photoreceptor. The output copy exhibits a pattern of light and dark interference fringes which look like the grains on a sheet of plywood, hence the expression "plywood effect" is generically applied to this problem. This phenomenon is described in greater detail below.

INFORMATION DISCLOSURE STATEMENT

U.S. Pat. No. 5,051,328 to J. Andrews et al., issued Sept. 24, 1991— A layered photosensitive imaging member is disclosed which has been modified to reduce the effects of interference within the member caused by reflections from coherent light incident on a base ground plane. The modification involves the formation of a ground plane of a low-reflecting material such as tin oxide or indium tin oxide. An additional feature is to add absorbing materials to the dielectric material upon which the ground plane is formed to absorb secondary reflections from the anti-curl back coating layer air interface or to the anti-curl layer itself. The absorbing material can be a dye such as Sudan Blue 670.

U.S. Pat. No. 4,618,552 to S. Tanaka et al., issued Oct. 21, 1986—A light receiving member is disclosed comprising an intermediate layer between a substrate of a metal of an alloy having a reflective surface on a photosensitive member, the reflective surface of the substrate forming a light-diffusing reflective surface, and the surface of the intermediate layer forming a rough surface. A light receiving member comprising a subbing layer having a light diffusing reflective surface with an average surface roughness of half or more of the wavelength of the light source for image exposure is provided between an electroconductive surface and a photosensitive layer. A light absorber can be contained in the electroconductive layer.

U.S. Pat. No. 5,215,839 to R. Yu, issued Jun. 1, 1993—A layered electrophotographic imaging member is disclosed. The member is modified to reduce the effect of interference caused by the reflections from coherent light incident on a ground plane. Modification involves an interface layer between a blocking layer and a charge generation layer, the interface layer comprising a polymer having incorporated therein filler particles of a synthetic silica or mineral particles. The filler particles scatter the light to prevent reflections from the ground planes back to the light incident the surface.

U.S. Pat. No. 5,096,792 to Y. Simpson et al, issued Mar. 17, 1992—A layered photosensitive imaging member is disclosed which is modified to reduce the effects of interference within the member caused by reflections from coherent light incident on a base ground plane. The modification involves a ground plane surface with a rough surface morphology by various selective deposition methods. Light reflected from the ground plane formed with the rough surface morphology is diffused through the bulk of the photosensitive layer breaking up the interference fringe patterns which are later manifested as a plywood pattern on output prints made from the exposed sensitive medium.

U.S. Pat. No. 5,139,907 to Y. Simpson et al., issued Aug. 18, 1992—A layered photosensitive imaging member is described which is modified by forming a low-reflection layer on the ground plane. The low-reflection layer serves to reduce an interference contrast and according to a second aspect of the invention, layer adhesion is greatly improved when selecting $TiO_2$ as the low-reflection material.

European Patent Application No. 0 462 439 A1, published Dec. 27, 1991—A layered photosensitive medium is modified to reduce the effects of destructive interference within the medium caused by reflection from coherent light incident thereon. The modification is to roughen the surface of the substrate upon which the ground plane is formed, the ground plane formed so as to conform to the underlying surface roughness. Light reflected from the ground plane is diffused through the bulk of the photosensitive layer breaking up the interference fringe patterns which are later manifested as a plywood defect on output prints made from the exposed photosensitive medium.

While the above-mentioned electrophotographic imaging members may be suitable for their intended purposes, there continues to be a need for improved imaging members, particularly for material modified multilayered electrophotographic imaging members in both flexible belt and rigid drum configurations.

SUMMARY OF THE INVENTION

It is therefore an object of the present invention to provide improved layered electrophotographic imaging members which overcome the above noted disadvantages.

It is also an object of the present invention to provide an improved layered electrophotographic imaging member in either flexible belt or rigid drum configuration with a modified hole blocking layer that possesses both hole blocking and anti reflection characteristics.

It is yet another object of the present invention to provide improved layered electrophotographic imaging members having a charge transport layer in contact with a charge generating layer for use with liquid or dry developers.

It is a further object of the present invention to provide improved layered electrophotographic imaging members having a supporting substrate, a single layer performing both hole blocking and reflection interference fringes elimination functions, an optional adhesive interface layer, a charge generating layer, and a charge transport layer.

It is yet another object of the present invention to provide improved layered electrophotographic imaging members having a supporting substrate, a charge transport layer, a charge generating layer, an optional adhesive layer, and an anti reflection hole blocking layer.

It is still another object of the present invention to provide improved positive charging electrophotographic imaging members having an anti reflection surface layer.

It is another object of the present invention to provide improved layered electrophotographic imaging members that exhibit high quality imaging and printing characteristics.

These and other objects of the present invention are accomplished by providing an electrophotographic imaging member comprising a substrate, a hole blocking, an optional interface adhesive layer, a charge generating layer, and a charge transport layer, the hole blocking layer comprising a light absorbing material selected from the group consisting of a dye, pigment and mixtures thereof dissolved or dispersed in a hole blocking matrix comprising a film forming polymer, the light absorbing material being capable of absorbing incident radiation having a wavelength between about 550 and about 950 nm. The dye or pigment may have a violet, blue, green, cyan or black color. These imaging members may be employed in an electrophotographic imaging process utilizing monochromatic activating radiation having a wavelength between a lower limit of about 600 and an upper limit of about 800 nm to form an electrostatic latent image on the imaging member. Electrophotographic imaging members free of any distinct adhesive layer in contiguous contact with the hole blocking layer are particularly preferred for drum configuration applications.

BRIEF DESCRIPTION OF THE DRAWINGS

A more complete understanding of the imaging device of the present invention purpose can be obtained by reference to the accompanying drawings wherein.

These figures are merely the schematic representations of the present invention and are not intended to indicate relative size and dimensions of electrophotographic imaging members or imaging apparatus or components thereof.

DETAILED DESCRIPTION OF THE DRAWINGS

For the sake of convenience, the invention will be described for electrophotographic imaging members in flexible belt form even though this invention includes electrophotographic imaging members having a rigid drum configuration.

Figure 1:
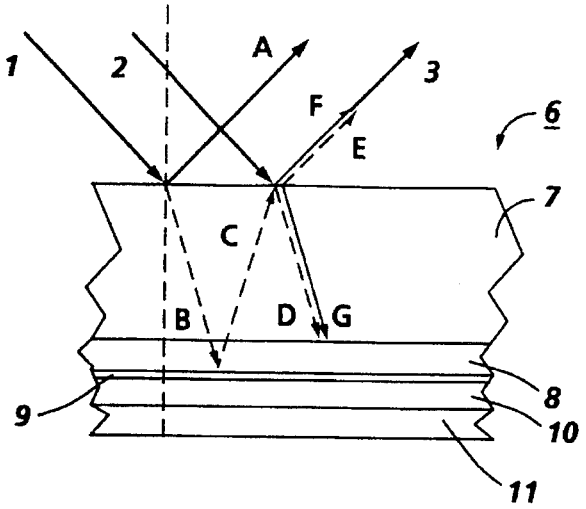
FIG. 1 PRIOR ART
FIG. 1 is a schematic representation showing coherent light incident upon a prior art layered photosensitive medium leading to reflections internal to the medium.

Referring to FIG. 1, a coherent beam incident on a layered electrophotographic imaging member 6 comprising a charge transport layer 7, charge generator layer 8, a conductive ground plane 9, a support substrate 10, and an anti-curl back coating 11. The interference effects which occur can be explained by following two typical rays of the incident illumination. The two dominant reflections of a typical ray 1, are from the top surface of layer 7, ray A, and from the top surface of ground plane 9, ray C. The transmitted portion of ray C, ray E, combines with the reflected portion of ray 2, ray F, to form ray 3. Depending on the optical path difference as determined by the thickness and index of refraction of layer 7, the interference of rays F and E can be constructive or destructive when they combine to form ray 3. The transmitted portion of ray 2, ray G, combines with the reflected portion of ray C, ray D, and the interference of these two rays determines the light energy delivered to the generator layer 8. When the thickness is such that rays E and F undergo constructive interference, more light is reflected from the surface than average, and there will be destructive interference between rays D and G, delivering less light to generator layer 8 than the average illumination. When the transport layer 7 thickness is such that reflection is a minimum, the transmission into layer 8 will be a maximum. The thickness of practical transport layers varies by several wavelengths of light so that all possible interference conductions exist within a square inch of surface. This spatial variation in transmission of the top transparent layer 7 is equivalent to a spatial exposure variation of generator layer 8. This spatial exposure variation present in the image formed on the electrophotographic imaging member becomes manifest in the output copy derived from the exposed electrophotographic imaging member. The output copy exhibits a pattern of light and dark interference fringes which look like the grains on a sheet of plywood, hence the term "plywood effect" is generically applied to this problem. In the event that the ground plane 9 used for the imaging member fabrication is an optically transparent layer, the internal reflection that causes the interference effect for plywood formation will no longer be coming from the top surface of the ground plane but rather from the bottom surface of anti-curl back coating 11 below, due to the refractive index mismatch between the anti-curl back coating (e.g. having a refractive index of 1.56) and the air (e.g. having a refractive index of 1.0) as the internal ray B passes through the optically clear substrate support 10 and the optically clear anti-curl back coating 11 before exiting to the air.

Figure 2:
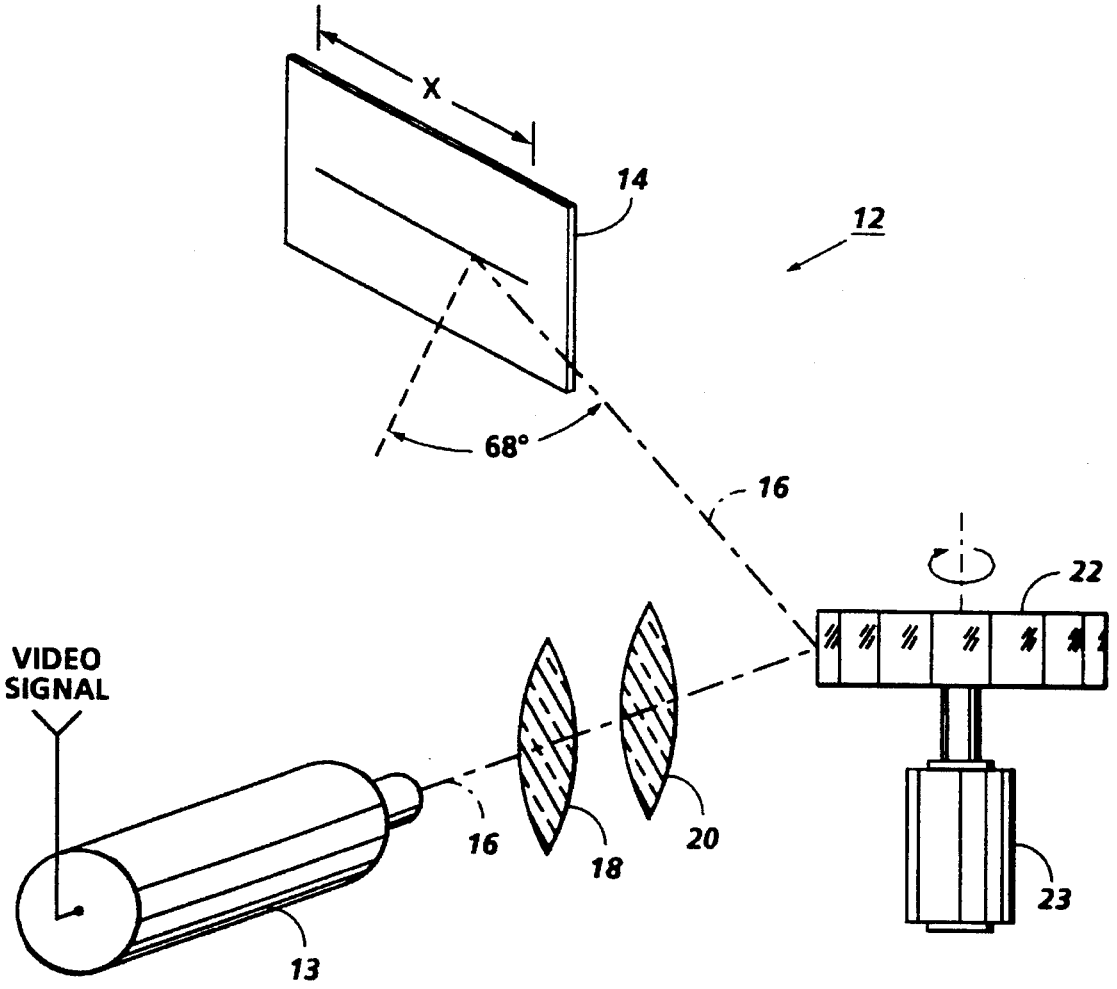
FIG. 2 is a schematic representation of an optical system incorporating a coherent light source to scan a light beam across an electrophotographic imaging member modified to reduce the interference effect according to the present invention.
Figure 6:
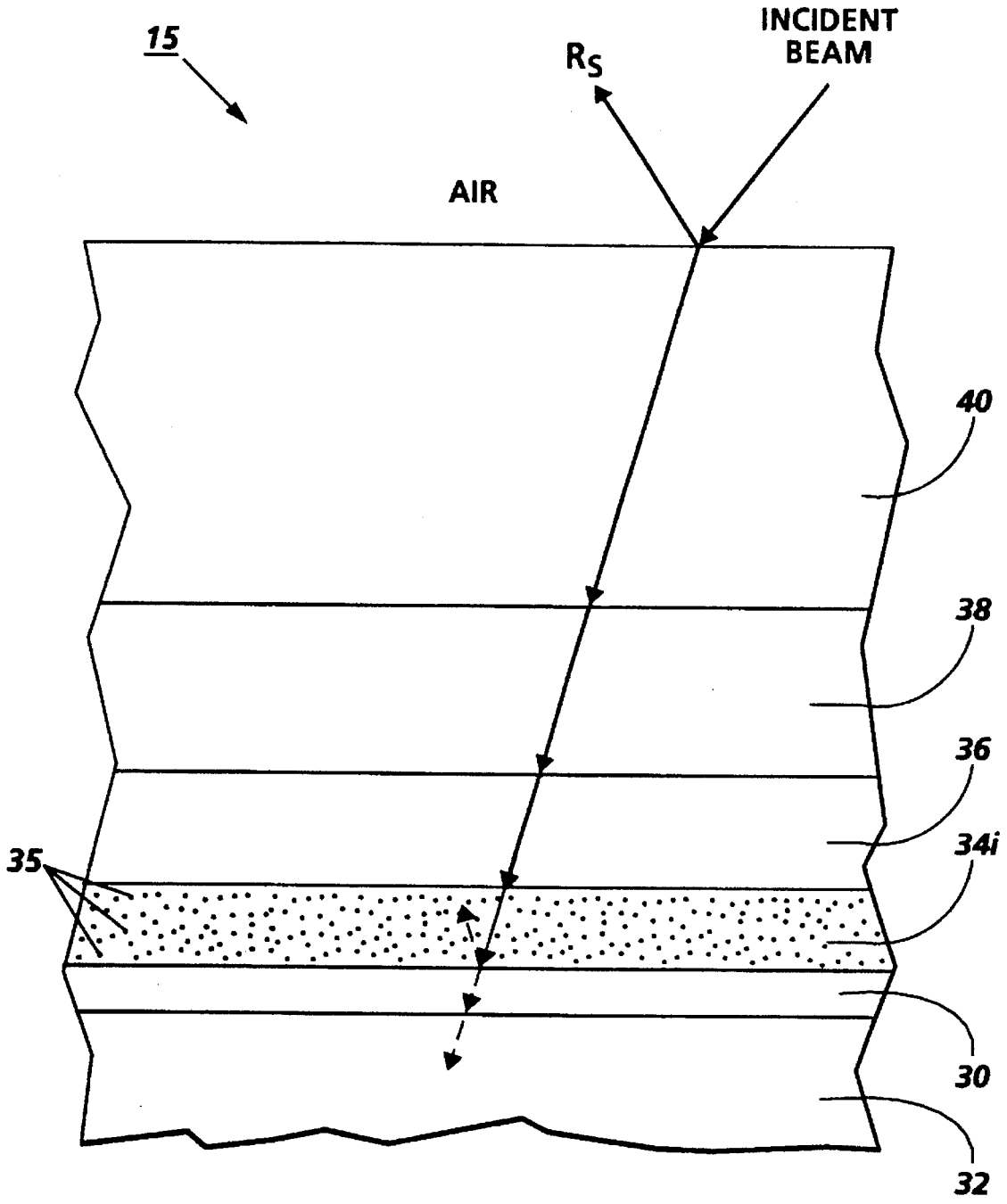
FIG. 6 is a partial schematic cross-sectional view of the electrophotographic imaging member of FIG. 5 wherein an organosilane hole blocking layer is replaced by a coherent light absorbing hole blocking layer according to the present invention.
Figure 7:
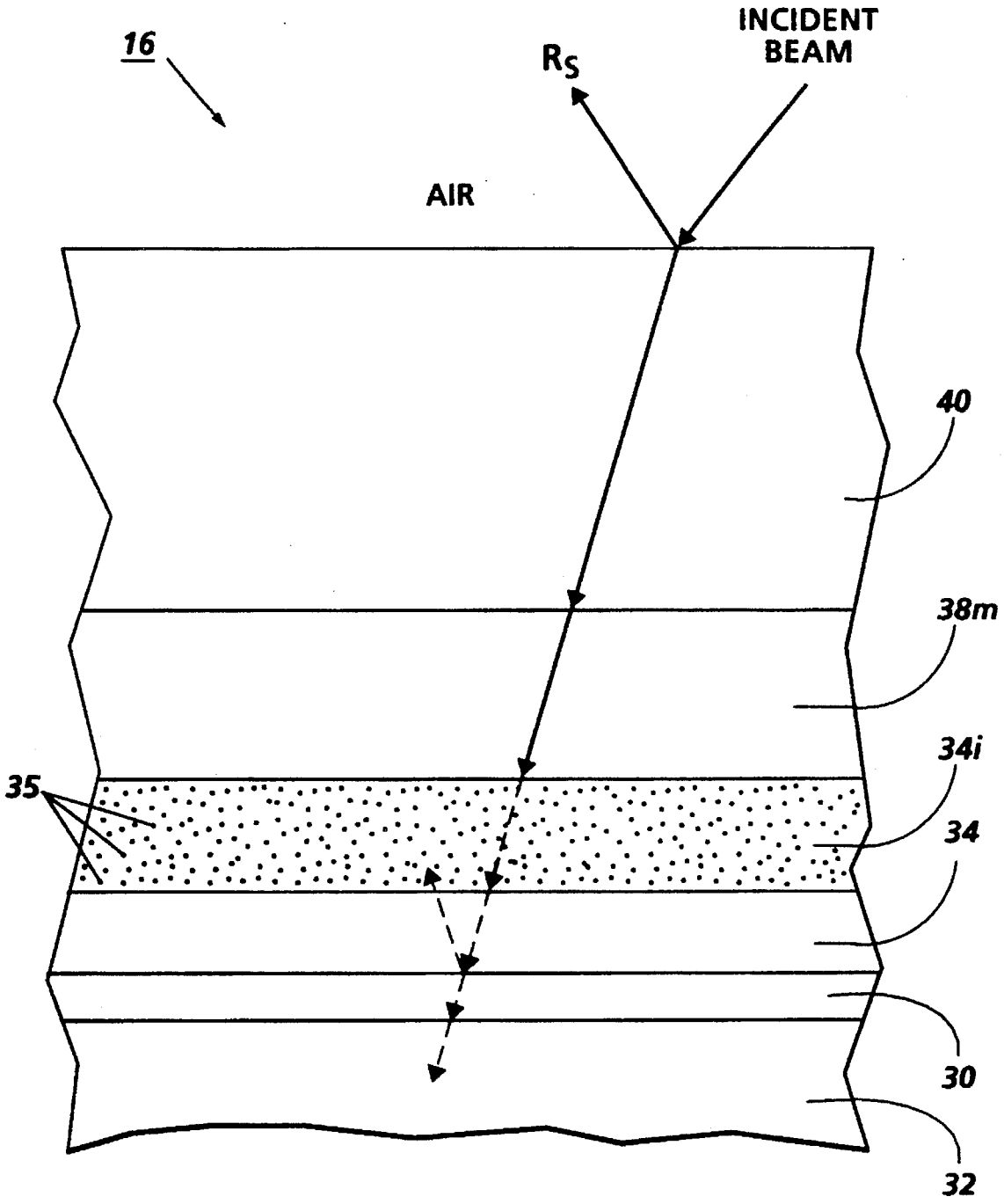
FIG. 7 is a partial schematic cross-sectional view of the electrophotographic imaging member of FIG. 5 wherein a coherent light absorbing hole blocking layer of the present invention is coated onto an organosilane hole blocking layer and the application of an interface adhesive layer is intentionally omitted.

FIG. 2 shows an imaging system 12 wherein a laser 13 produces a coherent output which is scanned across an electrophotographic imaging member 14. Laser 13 is, for this embodiment, a helium neon laser with a characteristic wavelength of 0.633 micrometer, but may instead be, for example, an Al Ga As Laser diode with a characteristic wavelength of 0.78 micrometer. In response to video signal information representing the information to be printed or copied, laser 13 is driven in order to provide a modulated light output beam 16. The laser output, whether gas or laser diode, comprises light which is polarized parallel to the plane of incidence. Flat field collector and objective lens 18 and 20, respectively, are positioned in the optical path between laser 13 and light beam reflecting scanning device 22. In a preferred embodiment, device 22 is a multifaceted mirror polygon driven by motor 23, as shown. Flat field collector lens 18 collimates the diverging light beam 16 and field objective lens 20 causes the collected beam to be focused onto electrophotographic imaging member 14, after reflection from polygon 22. Electrophotographic imaging member 14 is a layered photoreceptor of the prior art having the structure shown in FIG. 5 and/or a modified layered photoreceptor according to the invention as shown in FIGS. 6 and 7, the latter two being capable of eliminating plywood interference fringes.

Figure 3:
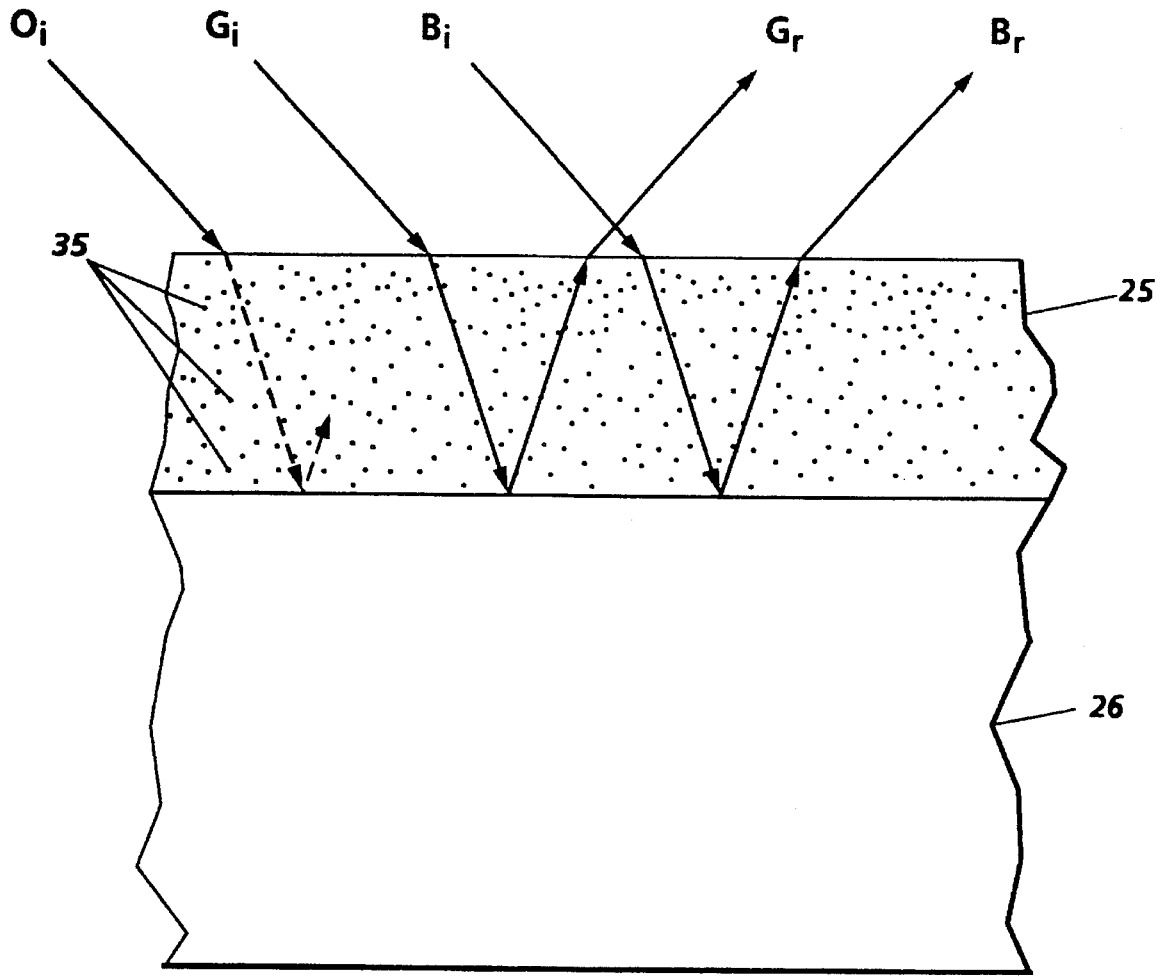
FIG. 3 is a schematic representation illustrating light beam interaction with a cyan dye containing polymer film coated over a reflective metal substrate.

To illustrate the light/matter interaction, incident light beams, shown in FIG. 3, comprising orange ($O_i$), green (Gi), and blue (Bi) colors are positioned to strike a cyan or blue dye 35 containing polymer film 25 which is coated over a reflective surface of a metal substrate 26. Although dye 35 is homogeneously dispersed at a molecular level within the polymeric matrix rather than as discreet particles, a dot representation in FIG. 3 is employed for purposes of illustration only. As shown in the schematic illustration of FIG. 3, the incident orange beam having a wavelength of about 633 nm is totally absorbed as it enters into the matrix of polymer film 25 containing cyan dye 35. Conversely, both the green and blue color components of the incident light beams travel through the entire polymer film thickness, being reflected back from the substrate 26 surface, into the polymer film 25 again, and then each reemerges as respective reflection beam Gr and Br with about the same intensity as the individual incident beam. The absence of the orange reflection beam is indicative of the effectiveness of selective light absorption by the cyan or blue dye in polymer film 25.

Figure 4:
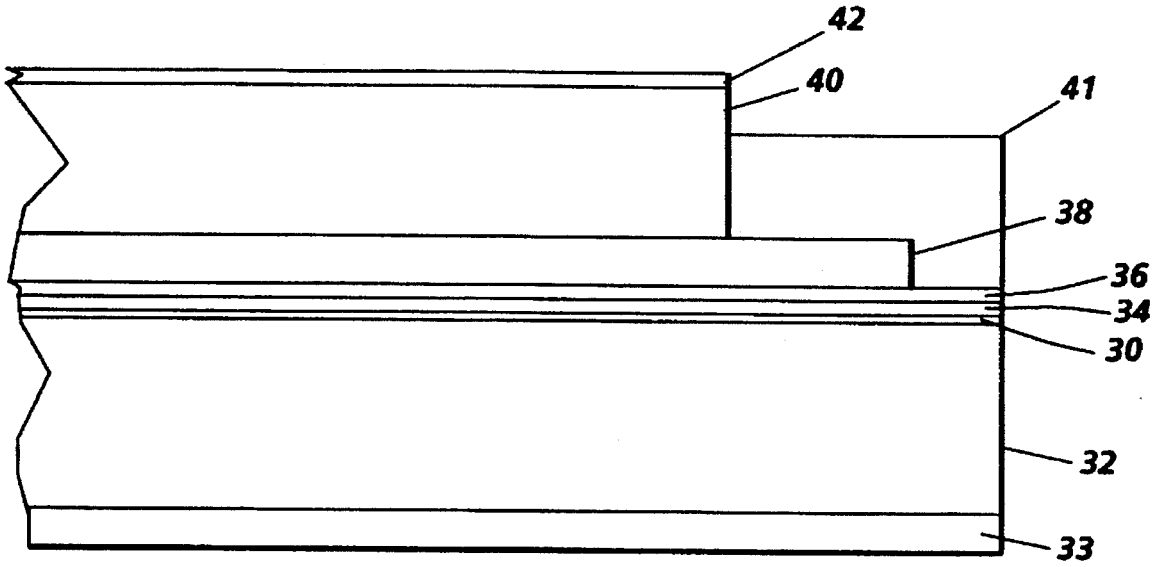
FIG. 4 is a more complete schematic cross-sectional view of a typical electrophotographic imaging member shown in FIG. 2.

In a typical electrophotographic imaging member shown in FIG. 4, the thickness of the substrate layer 32 depends on numerous factors, including mechanical strength and economical considerations, and thus, this layer for a flexible belt may, for example, have a thickness of at least about 50 micrometers, or of maximum thickness less than about 150 micrometers, provided there are no adverse effects on the final electrophotographic imaging device. For drum type imaging member applications, the substrate is normally a rigid cylinder. The conductive layer 30 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units and about 750 angstrom units, and more preferably between about 50 Angstrom units and about 200 angstrom units for an optimum combination of electrical conductivity, flexibility and light transmission. The conductive 30 layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface, a hole blocking layer 34 may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may comprise nitrogen containing siloxanes or nitrogen containing titanium compounds as disclosed, for example, in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and preferably has a thickness of less than about 0.2 micrometer.

An optional adhesive layer 36 may be applied to the hole blocking layer. Any suitable adhesive layer may be utilized. One well known adhesive layer comprises a polyester resin available as duPont 49,000 from duPont de Nemours & Co., a linear saturated copolyester reaction product of four diacids and ethylene glycol. The du Pont 49,000 linear saturated copolyester consists of alternating monomer units of ethylene glycol and four randomly sequenced diacids in the above indicated ratio and has a weight average molecular weight of about 70,000 and a $T_g$ of about 32° C. If desired, the adhesive layer may comprise a copolyester resin such as, for example, Vitel PE-100, Vitel PE-200, Vitel PE-200D, and Vitel PE-222, all available from Goodyear Tire and Rubber Co. The adhesive layer comprising this polyester resin is applied to the blocking layer. Any adhesive layer employed should be continuous and, preferably, have a dry thickness between about 200 micrometers and about 900 micrometers and, more preferably, between about 400 micrometers and about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

Any suitable photogenerating layer 38 may be applied to the blocking layer 34 or adhesive layer 36, if one is employed, which can thereafter be overcoated with a contiguous hole transport layer 40. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine described in U.S. Pat. No. 3,357,989, metal phthalocyanines such as vanadyl phthalocyanine and copper phthalocyanine, quinacridones available from E. I. duPont de Nemours & Co. under the tradename Monastral Red, Monastral violet and Monastral Red Y, Vat Orange 1 and Vat Orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of thereof being incorporated herein by reference. Other suitable photogenerating materials known in the art may also be utilized, if desired. Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light. The photogenerating materials selected should be sensitive to activating radiation having a wavelength between about about 600 and about 700 nm during the imagewise radiation exposure step in a electrophotographic imaging process to form an electrostatic latent image.

Any suitable inactive resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer 40 may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer 40 not only serves to transport holes or electrons, but also protects the photoconductive layer 38 from abrasion or chemical attack and therefor extends the operating life of the photoreceptor imaging member. The charge transport layer 40 should exhibit negligible, if any, discharge when exposed to a wavelength of light useful in xerography, e.g. 4000 angstroms to 9000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of illumination.

The active charge transport layer 40 may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multilayer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like. Molecular weights can vary from about 20,000 to about 1,500,000.

Examples of photosensitive members having at least two electrically operative layers, including a charge generator layer and diamine containing transport layer, are disclosed in U.S. Pat. Nos. 4,265,990, 4,233,384, 4,306,008, 4,299,897 and 4,439,507. The disclosures of these patents are incorporated herein in their entirety.

Any suitable and conventional techniques may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Other layers such as conventional ground strip layer 41 comprising, for example, conductive particles dispersed in a film forming binder may be applied to one edge of the photoreceptor in contact with the conductive layer 30, hole blocking layer, adhesive layer 36 or charge generating layer 38.

A conventional ground strip 41 may be utilized along one edge of the electrophotographic imaging member. The ground strip 41 may comprise a film forming polymer binder and electrically conductive particles. The ground strip 41 may comprise materials that include those enumerated in U.S. Pat. No. 4,664,995. The ground strip layer 41 may have a thickness from about 7 micrometers to about 42 micrometers, and preferably from about 14 micrometers to about 23 micrometers.

Optionally, an overcoat layer 42 may also be utilized to improve resistance to abrasion. In some flexible electrophotographic imaging members, an anti-curl back coating 33 may be applied to the side opposite the side bearing the electrically active coating layers in order to provide flatness and/or abrasion resistance. These overcoating and anti-curl back coating layers may comprise organic polymers or inorganic polymers that are electrically insulating or slightly semi-conductive. In embodiments using rigid drum imaging devices, an anti-curl coating is not employed.

The electrophotographic imaging member of the present invention may be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface.

Figure 5:
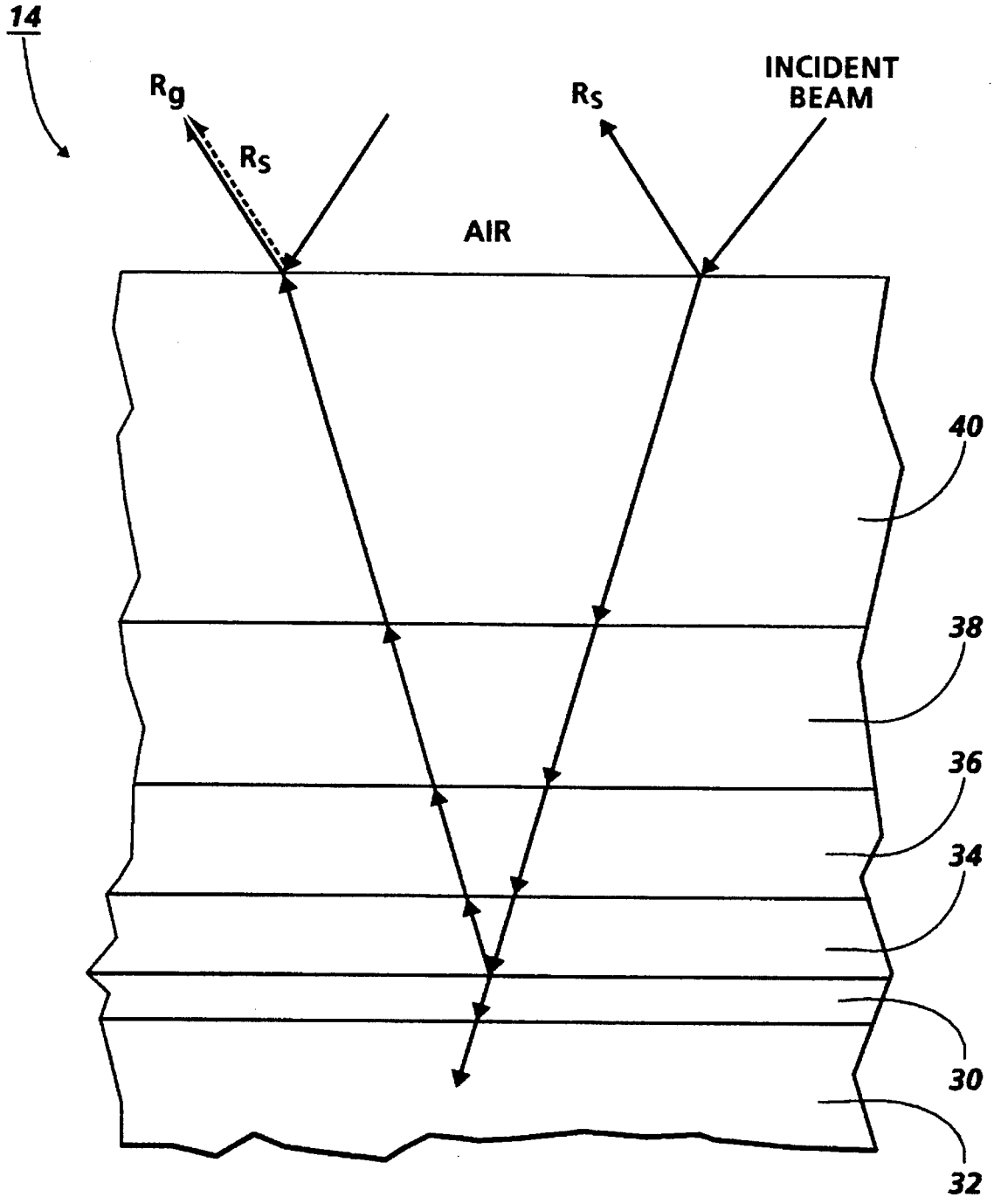
FIG. 5 is a partial schematic cross-sectional view of the electrophotographic imaging member of FIG. 4 with conventional coating layers to illustrate a plywood effect.

Referring to FIG. 5, light beam (e.g. 633 nm wavelength) interaction with a specific electrophotographic imaging member is schematically illustrated. The electrophotographic imaging member 14 is a flexible layered photoreceptor which includes, for purposes of illustration, a titanium conductive ground plane 30 formed on a polyethylene terephthalate dielectric supporting substrate 32. Conductive layer 30 has formed thereon an organopolysiloxane a blocking layer 34 which functions as a hole blocking layer. Formed on top of blocking layer 34 is a polyester adhesive interface layer 36 which, in turn, is coated with a charge generation layer 38. A charge transport layer 40 overlies charge generation layer 38.

As shown in FIG. 5, one incident beam of light is partially reflected as beam $R_s$. The remainder of the incident beam of light enters the charge transport layer 40 and is bent, due to the refractive index difference between air (having a value of 1.0) and layer 40 (having a value of 1.57). Since the refractive indexes of all the internal layers 34, 36, 38 and 40 are about the same, no significant internal refraction is normally encountered and the light, therefore, travels in a straight line through these layers. Although the residual light energy (after large photon absorption by layer 38) that eventually reaches the thin conductive layer 30 is partially transmitted through conductive layer 30, nevertheless, a greater fraction is reflected back to layer 40 and exits to the air as beam $R_g$. The emergence of the light energy $R_g$ from the photoreceptor 14 directly interferes with the reflected light $R_s$, resulting in the formation of an observed plywood fringes effect.

The present invention overcomes the shortcomings of the prior art by providing an imaging member with an improved hole blocking layer **34*i* shown in FIG. 6. Hole blocking layer 34*i* is a modification of the organopolysiloxane blocking layer 34 shown in FIG. 5 and is achieved by dissolving a blue dye or dispersing a blue pigment 35 in a hole blocking matrix material to achieve sufficient absorption of radiation which reaches blocking layer 34*i* so that substantially no radiation is reflected back into the overlying layers. Thus, this absorption eliminates the formation of reflection interference fringes. To more specifically illustrate elimination of interference fringe formation, the organoaminosilane hole blocking layer 34 of the electrophotographic imaging member of FIG. 5 is modified, in accordance with one embodiment of this invention, to form a 1.5 micrometers (15,000 Angstroms) thick layer comprising 89.5 percent poly (2-hydroxyethyl methacrylate), 9.5 percent gamma aminopropyltriethoxy silane, and 10 percent by weight of Alphazurine A cyan dye 35. The resulting electrophotographic imaging member 15 shown in FIG. 6 provides effective light energy absorption when the transmitted light enters hole blocking layer 34*i* as well as effecting reabsorption of any residual light energy reflected back from the ground plane 30 whereby beam Rg shown in FIG. 5** is totally eliminated.

The blocking layer of this invention is applied to the electrically conductive surface of the electrically conductive layer 30 or directly over an electrically conductive substrate. The applied blocking layer, after drying, comprises a light absorbing material selected from the group consisting of a dye, pigment and mixtures thereof dissolved or dispersed in a hole blocking matrix comprising a film forming polymer, the light absorbing material being capable of absorbing incident radiation having a wavelength between about 550 and about 950 nm.

Any suitable film forming polymer having inherent hole blocking property may be utilized in the blocking layer. Typical film forming polymers include, for example, hydroxyalkylcellulose, hydroxy methacrylate polymer (which may be a homopolymer, a copolymer, a terpolymer or the like) such as poly(2-hydroxyethyl methacrylate) or copolymer poly(2-hydroxyethyl methacrylate)-poly(methyl acrylamido glycolate methyl ether) or copolymer poly(2-hydroxyethyl methacrylate)-poly(2-hydroxypropyl methacrylate), Luckamide, Elvamide, nylon, gelatin, and the like and blends thereof. The film forming polymer may itself possess blocking properties or it may be blended with other materials that impart blocking properties to the a hole blocking matrix.

A preferred hydroxyalkylcellulose film forming polymer component for the hole blocking layer coating composition of this invention is a commercially available non-ionic cellulose ether. A typical hydroxyalkylcellulose is available as hydroxypropylcellulose or KLUCEL from Hercules Incorporated. KLUCEL is prepared by reacting alkali cellulose with propylene oxide at elevated temperature and pressure. The propylene oxide can be substituted on the cellulose through an ether linkage at the three reactive hydroxyl groups present on each anhydroglucose monomer unit of the cellulose chain. It is believed that etherification takes place in such a way that hydroxypropyl substituent groups contain almost entirely secondary hydroxyl groups. The secondary hydroxyl present in the side chain is available for further reaction with the oxide, and chaining out may take place. This results in formation of side chains containing more than one mole of combined propylene oxide. It is probable that most of the primary hydroxyl groups on the cellulose have been substituted and that the reactive groups remaining are secondary hydroxyl groups. Some typical molecular weight values are H-type 1,000,000; G-type 300,000; L-type 100,000; and E-type 60,000. An idealized structure of a hydroxyalkylcellulose molecule is shown below:

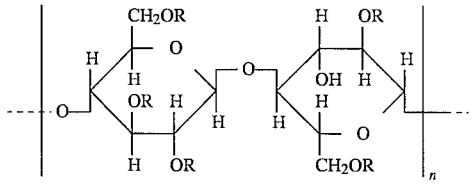

wherein R is independently selected from the group consisting of hydrogen and a substituted or unsubstituted group selected from the group consisting of an alkyl group containing 1 to 20 carbon atoms, a hydroxyalkyl group containing 1 to 20 carbon atoms, an hydroxyether group containing 1 to 20 carbon atoms and an aminoalkyl group containing 1 to 20 carbon atoms, and n is the number of cellulose repeating units from 1 to 3,000. A preferred cellulosic material for the blocking layer of this invention is a hydroxyalkylcellulose compound and derivatives thereof having a degree of substitution of up to 3 molar substitutions of the hydroxyl group of the cellulose per monosaccharide unit and having a weight average molecular weight between about 700 and about 2,000,000. The abundant hydroxy functional groups of the hydroxypropylcellulose are incorporated into a crosslinked network with the silane components to form a reaction product layer having improved elasticity, better coating layer uniformity, and no silane aggregations or coating thickness variation problems that can occur when hole blocking layers containing only silane are dried by heating.

An unmodified hydroxy methacrylate polymer that can be employed as component of the hole blocking layer coating composition of this invention is shown in the generalized molecular formula below:

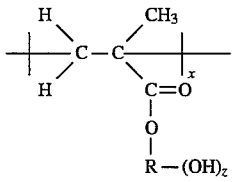

wherein:

x represents sufficient repeat units for a weight average molecular weight between about 400,000 and about 5,000,000, R is a divalent group selected from the group consisting of a linear or branched saturated aliphatic hydrocarbon group containing 1 to 6 carbon atoms and a linear or branched saturated cycloaliphatic hydrocarbon group containing 1 to 6 carbon atoms, and z contains from 1 to 6 hydroxyl groups Typical high molecular weight unmodified hydroxy methacrylate polymers include poly(4-hydroxybutyl)methacrylate, poly(3-hydroxypropyl)methacrylate, poly(2,3-dihydroxypropyl)methacrylate, poly(2,3,4-trihydroxybutyl)methacrylate, poly(2-hydroxyethylmethacrylate), poly(2-hydroxypropylmethacrylate) and the like. These unmodified hydroxy methacrylate polymers are, in general, water insoluble and particularly insoluble organic coating solvents utilized in subsequently applied coatings. These polymers attract about one weight percent by weight water and retain much of the trapped water in a dense hydrogen bonded network even at low RH. The trapped water assists in the transport of photodischarged electrons through the blocking layer to the conductive layer and also assists in preventing electron trapping and $V_R$ cycle-up. The higher the hydroxy methacrylate blocking layer polymer molecular weight, the higher the intermolecular H-bonding density and retentive trapping of water at low RH, and the greater the effectiveness as a solvent barrier (to prevent solvent wash away of the blocking layer).

The presence of the ester group along with a hydroxyl group in each polymeric repeat unit not only maximizes intermolecular H-bonding in the form of OH—OH H-bonding and carbonyl (of the ester) —OH-bonding, but also allows for some intramolecular (5, 6 and 7 membered rings) H-bonding to maintain overall H-bonding density particularly in those blocking layer areas where intermolecular H-bonding is below the average, presumably because of conformationally unfavorable chain configurations. Thus, this intramolecular mode of H-bonding along with trapped water can maintain high H-bonding density which assists electron transport and completes photodischarge (low $V_R$). All of these properties contribute to enhanced photoreceptor electrical performance.

The water insoluble high molecular weight hydroxy methacrylate polymer may be crosslinked and uncrosslinked. If crosslinked, crosslinking may be effected by any suitable difunctional (or higher polyfunctionality) compound (usually a small molecule) that can react with hydroxyl groups at temperatures of less than about 135° C. to crosslink the hydroxy ester polymer through the hydroxyl groups. Higher temperatures may be utilized if the substrate is not adversely softened at the reaction temperatures.

Any suitable technique may be utilized to crosslink hydroxy methacrylate polymers through the hydroxyl groups. Generally, if catalysts are employed with the polyfunctional compounds, care should be taken to wash out the catalyst and avoid catalytic residues in the final blocking layer which might adversely affect electrical properties. Similarly, other permanent non-volatile residues which might interfere with the desired final electrical properties of the blocking layer should be avoided. This also ensures that there is no undesirable residue that could migrate out of the blocking layer or which could function as an electron trap in the blocking layer. The expression "unmodified" as employed herein is defined as an uncross-linked hydroxy methacrylate polymer comprising about the same number of hydroxy methacrylate repeat units in the hydroxy methacrylate monomer(s) that underwent conversion to polymer, or a hydroxy methacrylate cross-linked polymer having a decreased number of hydroxyl groups in the hydroxy methacrylate repeat units versus the hydroxy methacrylate monomer(s) that underwent conversion to the polymer wherein the decrease is based exclusively on the hydroxyl groups consumed in the cross-linking process. Thus, if a, polymer is modified, a chemical grouping is attached to the unmodified polymer as a pendent group that is not capable of cross-linking with itself or other repeat units in the modified polymer.

Satisfactory results may be achieved with water insoluble high molecular weight unmodified hydroxy methacrylate polymers having a weight average molecular weight of at least about 300,000, the upper limit being limited by the viscosity necessary for processing (generally about 5,000,000). Preferably, the weight average molecular weight is between about 600,000 and about 5,000,000. Optimum blocking layer performance is obtained when the weight average molecular weight is between about 950,000 and about 5,000,000. When the weight average molecular weight is less than about 300,000, the hydroxy methacrylate blocking layer becomes less effective as a barrier layer thereby allowing unwanted migration of electroconductive layer species into the blocking layer and subsequently coated layers, and the hydroxy methacrylate blocking layer also becomes less effective as an electron transporting material because of a lower level of water entrapment therein especially at low RH. These low molecular weight deficiencies result in inferior cyclic electrical properties in the form of $V_0$ cycle down and $V_r$ cycle-up. $T_g$ or glass transition temperature has no known effect on the ability of a hole blocking layer of this invention to function effectively.

Optimum results are achieved with the water insoluble high molecular weight unmodified hydroxy methacrylate polymer poly(2-hydroxyethylmethacrylate) which is represented by the following formula:

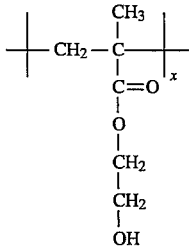

wherein x represents sufficient repeat units for a weight average molecular weight between about 300,000 and about 5,000,000.

Another preferred vinyl hydroxy ester polymer is poly(2-hydroxypropylmethacrylate) which is represented by the following formula:

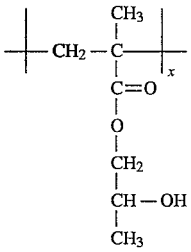

wherein x represents sufficient repeat units for a molecular weight between about 300,000 and about 5,000,000.

The water insoluble high molecular weight unmodified hydroxy methacrylate polymers of this invention may be blended with other miscible water insoluble high molecular weight unmodified hydroxy methacrylate compatible polymers to provide a blended blocking layer of this invention. Typical miscible water insoluble high molecular weight unmodified hydroxy methacrylate polymers include poly(2-hydroxyethyl methacrylate), poly(2-hydroxypropyl methacrylate), poly(4-hydroxybutyl)methacrylate, poly(3-hydroxypropyl)methacrylate, poly(2,3-dihydroxypropyl)methacrylate, poly(2,3,4-trihydroxybutyl)methacrylate and the like. Miscibility is defined as a non-hazy coating (after drying) of equal amounts of the two copolymers cast from common solution of the two copolymers in one solvent. These are all random (not blocked) copolymers, but block copolymers prepared by group transfer polymerization (GTP) may also be used when prepared at the high molecular weights previously defined for satisfactory, preferred and optimum blocking layer compositions. These polymers are capable of forming dense OH—OH and ester group-OH H-bonding sites which are sufficiently numerous to prevent large domain phase separation. The blended water insoluble high molecular weight unmodified hydroxy methacrylate polymers may be blends of homopolymers, copolymers or terpolymers or blends of some or all of the above or may have as many different repeat units as desired providing that all the repeat units are derived from unmodified hydroxy methacrylate monomers capable of being polymerized to water insoluble high molecular weight polymers. The mole percent of each hydroxy methacrylate repeat unit in the copolymer should be chosen so as to provide the maximum solvent barrier properties to solvents used to apply subsequent photoreceptor layers thereby minimizing deleterious interlayer mixing which leads to unsatisfactory cyclic electrical properties. The specific composition selected for the ground plane will influence the thickness of the hole blocking layer selected. Generally, non-metallic or oxidizable charge injection ground plane materials require a thicker hole blocking layer.

Any suitable hole blocking material may be blended with the film forming polymer. Hole blocking materials are well known in the art. Typical hole blocking materials include, for example, organoaminopolysiloxanes, polyhydroxy alkylcellulose, polyhydroxy methacrylate, polyurethane, polyamide, polyaminoacid, and the like and mixtures thereof.

A preferred hole blocking material is a reaction product of a hydrolyzable organoaminosilane. The preferred organoaminosilane for the hole blocking layer is capable of formation of chemical bonds with the oxidized metal surface of a substrate or conductive layer as well as facilitating chemical reaction with film forming polymers having reactive groups such as the hydroxy propylcellulose and hydroxy methacrylate polymer described above to co-crosslink these two components into a three dimensional network structure. Thus, the preferred organoaminosilane component for the hole blocking layer coating composition of this invention comprises a hydrolyzable organoamino silane which preferably reacts with reactive film forming polymer component in the hole blocking layer. The hydrolyzable organoaminosilane may be represented by the following formula:

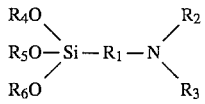

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms. The organoaminosilane is hydrolyzed in an aqueous solution with or without the other components of the charge blocking layer of this invention at a pH between about 4 and about 10. Typical hydrolyzable silanes include 3-aminopropyl triethoxy silane, (N,N-dimethyl 3-amino) propyl triethoxysilane, N,N-dimethylaminophenyl silane, N-phenyl aminopropyl trimethoxy silane, triethoxy silylpropylethylene diamine, trimethoxy silylpropylethylene diamine, trimethoxy silylpropyldiethylene triamine, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred organoaminosilane materials are 3-aminopropyltriethoxysilane, N-aminoethyl-3-aminopropyltrimethoxysilane, (N,N'-dimethyl 3-amino)propyltriethoxysilane, and the like or mixtures thereof because the hydrolyzed solutions of these materials exhibit a greater degree of basicity and stability and because these materials are readily available commercially.

The hydrolyzed organoaminosilane solution may be prepared by adding sufficient water to hydrolyze the hydrolyzable groups attached to the silicon atom to form a solution. During hydrolysis of the organoaminosilanes, the hydrolyzable groups such as alkoxy groups are replaced with hydroxyl groups. Insufficient water will normally cause the hydrolyzed silane to form an undesirable gel. Generally, dilute solutions are preferred for achieving thin coatings. Satisfactory reaction product films may be achieved with solutions containing from about 0.01 percent by weight to about 5 percent by weight of the silane based on the total weight of the solution. A solution containing from about 0.05 percent by weight to about 3 percent by weight silane based on the total weight of solution are preferred for stable solutions which form uniform reaction product layers. It is critical that the pH of the solution of hydrolyzed silane be carefully controlled to obtain optimum effects as on curing as well as electrical stability. A solution pH between about 4 and about 10 is preferred. Optimum reaction product layers are achieved with hydrolyzed silane solutions having a pH between about 7 and about 8, because inhibition of cycling-up and cycling-down characteristics of the resulting treated photoreceptor are maximized. Cycling-down may occasionally be tolerable with hydrolyzed amino silane solutions having a pH less than about 4.

Control of the pH of the hydrolyzed silane solution may be effected with any suitable organic or inorganic acid. Typical organic and inorganic acids include acetic acid, citric acid, formic acid, hydrogen iodide, phosphoric acid, hydrofluorsilicic acid, p-toluene sulfonic acid and the like.

A typical hole blocking layer coating solution of the present invention comprising between about 1 percent and about 16 percent by weight of hole blocking polymer and organoaminosilane in acetic acid, water, and alcohol along with a small quantity of dissolved blue dye gives satisfactory results. The acetic acid is added to neutralize the organoaminosilane and adjust the pH of the solution; water is used to provide hydrolysis reaction of the silane; and the alcohol serves as the solvent medium for the coating solution. A preferred hole blocking layer coating solution may contain about 3 percent to about 10 percent by weight of dissolved polymer/silane materials. However, the optimized polymer/silane content in the coating solution is between about 4 percent and about 6 percent by weight based on the total weight of the solution. To determine the exact amounts of acid and water to be added to a specific solution formulation, an optimized hole blocking solution comprising 4 percent by weight of 9.4 parts poly(2-hydroxyethyl methacrylate)/1 part gamma aminopropyltriethoxy silane weight ratio in 1.2 percent by weight acetic acid, 16 percent by weight distilled water, and 78.8 percent by weight Dowanol® plus 0.045 percent by weight of dissolved blue dye is cited here to serve as an example of a solution illustrating that the relative amounts of acetic acid and water for all the coating solution preparations should be based on the amount of silane used in the coating solution in accordance with the weight ratio of acid/silane and water/silane described in the example, to ensure a complete hydrolysis reaction as well as to control the pH of the resulting coating solution. When applied over the surface of a titanium/polyethylene terephthalate supporting substrate, using a 1.5 mil gap bar by hand coating, followed by drying at 135° C. for 5 minutes in an air circulating oven, the solution example described above yields a 1.5 micrometers (15,000 Angstroms) thick hole blocking layer of this invention containing 89.5 percent poly(2-hydroxethyl methacrylate), 9.5 percent gamma aminopropyltriethoxy silane, and 1 percent by weight blue dye. The preferred polymer/silane weight ratio ranges from about 10/1 to about 1/10, with optimum results being obtained with a weight ratio between about 9.5/1 and about 5/5.

Typical blends of a film forming polymer and a hole blocking material to form a hole blocking matrix include, for example, hydroxyalkylcellulose and organoaminosilane; hydroxy methacrylate polymer (which may be a homopolymer, a copolymer, a terpolymer or the like) and silane such as poly(2-hydroxyethyl methacrylate) and organoaminosilane, or copolymer poly(2-hydroxyethyl methacrylate)poly(methyl acrylamido glycolate methyl ether) and organoaminosilane, or copolymer poly(2-hydroxyethyl methacrylate)-poly(2-hydroxypropyl methacrylate) and organoaminosilane; and the like. These polymeric film forming materials are preferred for physical blending with the organoaminosilane because they inherently possess good hole blocking capabilities, are readily soluble in polar solvents used for silane coating solution preparation, and are able to form a smooth and uniform coating layer. If good adhesion is not an important requirement such as in the case of drum type electrophotographic imaging members, the hole blocking layer of this invention purpose may merely contain the dye or pigment and a film forming polymer having inherent hole blocking property or the dye or pigment and a blend comprising two or multi-component hole blocking film forming polymers. The resulting hole blocking layer forms an electronic barrier to prevent injection of holes into the adjacent photoconductive layer from the underlying conductive layer.

The light absorbing material selected from the group consisting of a dye, pigment and mixtures thereof dissolved or dispersed in a hole or electron blocking matrix should be capable of absorbing substantially all incident radiation having a wavelength between about 550 and about 950 nm. Typical dyes or pigments capable of absorbing incident radiation in this wavelength range usually have a violet, blue, green, cyan or black color. Although the specific bandwith of radiation absorbed varies with different dyes or pigments, the dye or pigment or mixtures thereof selected for any given hole blocking layer should absorb substantially all of the activating radiation frequencies to which the charge generator layer employed is exposed.

When dissolved or dispersed within the matrix of a polymeric film, the absorption capability of the incident radiation, according to the Beer-Lambert Law, is directly proportional to either the thickness of the film or the concentration of the dye in the film. The Beer-Lambert Law of absorption is given in the equation below:

$$A=ect$$

where A is absorbency e is the extinction coefficient c is the concentration of dye or pigment t is the thickness of the hole blocking layer Typical violet, blue, green, cyan or black dyes include, for example, those available from Allied Chemical such as Alphazurine A, Cotton Blue C4B, Celestine Blue B, Aniline Blue, Acid Alizarin Blue BB, Azure II, and the like; those available from J. T. Baker such as Alkali Blue 4B (or 6B), Poirrier's Blue, Variamine Blue B Hydrochloride, Alcian Blue 8 gx, Trypan Blue, Xylenol Blue, Niagara Sky Blue 6B, Evon's Blue, and the like; and other blue dye or pigments such as Methylene Blue; Phenylene Blue; Prussian Blue; Waxoline Blue; Sudan Blue; Rhodanile Blue; Procion Brilliant Blue; Milling Blue; Nile Blue; Methyl Violet; Naphthol Blue Black; Sudan Black; Bromocresol green; Bromophenol blue; and the like. Typical pigments include Manganese Violet, Ultramarine Violet, Ultramarine Blue, Cobalt Aluminate Blue, Iron (or Milori) Blue, Chromic Oxide Green, Cobalt Titanate Green, Cobalt Chromite Green, black iron oxide, and the like.

If the light absorbing material is in the form of violet, blue, green, cyan or black pigment particles dispersed in the hole blocking matrix rather than a dye dissolved in the hole blocking matrix, the pigment particles should have an average particle size substantially smaller than the thickness of the invention blocking layer and preferably between about 0.5 micrometer and about 5 micrometers.

Generally, the relative amount of light absorbing material utilized in the blocking layer depends upon the average size of the particles (if a pigment) and the thickness of the blocking layer. Sufficient light absorbing material should be present to absorb radiation which reaches the blocking layer so that substantially no incident radiation is reflected back into the overlying layers. Therefore, the extent of light absorption, described according to the Beer-Lambert Law, is that the light absorptivity of the hole blocking layer of this invention is directly proportional to the product of the thickness of the hole blocking layer and the concentration of dye or pigment present. A hole blocking layer of this invention containing sufficient dye or pigment content, should be continuous and have a thickness of greater than about 0.5 micrometer (5,000 Angstroms) because thinner hole blocking layer coatings may provide insufficient light absorption to suppress plywood fringes, may fail to produce complete film coverage of the conductive substrate, and may lead to the formation of undesirable bare spots at the surface of the substrate. A hole blocking layer thickness of between about 0.5 micrometer (5,000 Angstroms) and about 5 micrometers (50,000 Angstroms) is preferred to ensure achievement of complete ground plane/substrate surface coverage, to facilitate hole neutralization after the exposure step, and securing optimum electrical performance. A thickness of between about 1 micrometer (10,000 Angstroms) and about 3 micrometers (30,000 Angstroms) is particularly desirable for hole blocking layers in order to achieve optimum electrical behavior. To effect reflection fringes suppression in a fabricated electrophotographic imaging member, a dye or pigment content ranging from about 1 percent to about 30 percent by weight, based on the total dried weight of the blocking layer is satisfactory for the hole blocking layer of this invention. Optimum results are achieved when the dye or pigment level is between about 3 percent and 20 percent by weight, based on the total weight of the dried blocking layer. To provide effective hole blocking capabilities, the hole blocking layer of this invention should have an electrical resistivity between about $10^3$ ohm-cm and and about $10^{12}$ ohm-cm. A resistivity of less than $10^3$ will result in large amount in electrical cycle-down whereas an electrical resistivity greater than $10^{12}$ ohm-cm is too electrically insulative. When the layer is too insulative, substantial background voltage rise occurs during use in electrophotographic imaging processes. For optimum results, electrical resistivity ranges between about $10^7$ ohm-cm to about $10^{10}$ ohm-cm is desirable.

The hole blocking layer of this invention has a sufficient light absorption capacity to remove back reflection from the conductive metal ground plane. Imaging members containing the hole blocking layer of this invention are exposed with monochromatic activating radiation having a wavelength between a lower limit of about 600 and an upper limit of about 800 nm to form an electrostatic latent image on the imaging member. This latent image is developed with toner particles using conventional techniques to form a toner image corresponding to the latent image. The toner image is transferred to a receiving member by any suitable well known processes. This approach for obviating the formation of plywood interference fringes, is superior to approaches involving a light absorbing substrate (or a light scattering rough substrate) or a light absorbing anti-curl backing layer (or a light scattering anti-curl blocking layer) for the following reasons:

Since electrophotographic imaging members, in either a flexible belt or rigid drum configuration, usually employ a highly reflective metallic coating over a plastic substrate support or the substrate itself is a highly reflective metallic material, the hole blocking layer of this invention applied over the metal/substrate support can more effectively capture the light energy passing through and the back reflection from the metal coating.

The use of a light absorbing substrate or a light absorbing (or light scattering) anti-curl backing layer requires that the conductive ground plane be absolutely optical transparent to yield good results, an unusual condition that is difficult to meet.

Since rigid drum electrophotographic imaging members require no anti-curl backing layer, a light absorbing or a light scattering anti-curl layer is applicable only for flexible imaging belt fabrication. In contrast, the hole blocking layer of the present invention can be implemented in both flexible imaging belts as well as rigid imaging drums.

The use of a light scattering substrate (a roughened surface for flexible imaging webs) tends to scratch the thin metal coating normally used in the ground plane as well as thin hole blocking layers, such as those containing organosiloxanes, during the winding, un-winding, and rewinding steps utilized during the electrophotographic imaging web coating processes. These scratches manifest themselves as printout defects in final copies.

Commercially available roughened flexible substrates are usually loaded with a high concentration of fillers and have lower optical transmittance which renders back erase of imaging members extremely difficult to accomplish.

Thin blocking layers employed in coventional imaging members, such as organosiloxane blocking layer materials, tend to produce incomplete coating coverage over roughened substrates in both the flexible web and rigid drum configurations.

Since each coating solution formulation contains adequate amounts of organic polar solvent, a small amount of acid to control the pH, and a small quantity of water to promote the hydrolysis reaction, they also promote wetting of the metal oxide layer of metallic conductive anode layer. Improved wetting ensures achievement of greater uniformity of the coating layer thickness as well as a crosslinking reaction between the hydrolyzed silane, polymer, and metal oxide layer of the conducting ground plane. Any suitable polar solvent additive may be employed. Typical polar solvents include methanol, ethanol, isopropanol, n-butanol, tertiary butyl alcohol, 1-methoxy-2-hydroxy propane, tetrahydrofuran, methylcellosolve, ethylcellosolve, ethoxyethanol, ethylacetate, ethylformate and mixtures thereof. Optimum wetting is achieved with a mixture of isopropyl alcohol and n-butanol as the organic polar solvent additive. Where a hydrolyzed silane solution is employed, the amount of polar solvent generally added, is less than about 95 percent based on the total weight of the solution for best results.

The hole blocking layer solution may be deposited on the metal oxide surface by any suitable technique. Typical application techniques include spraying, dip coating, draw bar coating, gravure coating, silk screening, air knife coating, reverse roll coating, and the like. The hole blocking layer coating solutions of this invention are desirable for both webs and dip coating processes. For obtaining relatively thick hole blocking layers in drum electrophotographic imaging members, the blocking layers are preferably applied by dip coating substrates such as drums in a coating solution, with the solvent being removed after deposition of the coating by conventional techniques such as by vacuum, heating and the like.

Drying or curing of the invention hole blocking layer coating upon the metal oxide layer should be conducted at a temperature greater than about room temperature to provide a reaction product layer having more uniform electrical properties, more complete conversion of the reactants and less unreacted components. Generally, a reaction temperature between about 100° C. and about 150° C. is preferred for maximum conversion, adhesion, and elasticity. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus, less reaction time is required when higher reaction temperatures are employed. Generally, increasing the reaction time increases the degree of cross-linking of the reactants. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures.

One may readily determine whether sufficient condensation reaction in the cross-linking process has occurred in the coating layer matrix to form a network structure having stable electrical, chemical and mechanical properties for the final electrophotographic imaging member to withstand the operating conditions in a machine environment, by merely washing the dried coating with water, toluene, tetrahydrofuran, methylene chloride or cyclohexanone and examining the washed coating to compare infrared absorption of Si—O-wavelength bands between about 1,000 to about 1,200 $cm^{-1}$. If the Si—O-wavelength bands are visible, the degree of reaction is sufficient, i.e. sufficient condensation and crosslinking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer and the other components of the charge blocking layer. The reaction of hydrolyzed silane with metal hydroxide molecules in the pores of the metal oxide layer is described in U.S. Pat. No. 4,464,450 to L. A. Teuscher, the disclosure of which is incorporated herein in its entirety.

In FIG. 7, an electrophotographic imaging member 16 shown containing a dual hole blocking layer embodiment of this invention is illustrated. In this dual hole blocking layer embodiment, a hole blocking layer of this invention, such as the hole blocking layer **34*i* described above with reference to FIG. 6, is applied directly over another hole blocking layer. Thus, for example, the hole blocking layer 34 shown in FIG. 7 can be a 00.05 micrometer (500 Angstroms) gamma aminopropyltriethoxy silane layer. The imaging member illustrated in FIG. 7 does not contain the interface adhesive layer 36 shown in FIG. 6. Where greater adhesion is desired, for example in a flexible belt, a modified charge generating layer 38 m containing an adhesive material may be utilized. For example, modified charge generating layer 38 m may typically contain about 10 percent by weight 49,000 polyester to promote adhesion. The electrophotographic imaging member 16 shown in FIG. 7 can suppress plywood fringe problem through the same light absorption mechanism described in FIG. 6. For satisfactory results, the thickness of the organoaminosilane layer 34** can vary from about 0.005 micrometer (50 Angstroms) to about 0.2 micrometer (2,000 Angstroms).

If desired, an interface adhesive layer may be interposed between the hole blocking layer below and the overlying photoconductive layer to enhance adhesion.

The present invention is directed towards eliminating the reflected light from the metallic ground plane by modifying the composition of the organoaminosilane hole blocking layer which lies between the charge generating layer above and the ground plane below. Successful resolution of the reflection interference fringes problems through the providing of a light absorption hole blocking layer of this invention does not appear to adversely affect the photoelectrical integrity of the original electrophotographic imaging member.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

An electrophotographic imaging member was prepared by providing a titanium coated polyester substrate (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with a ½ mil gap Bird applicator to the blocking layer a wet coating containing 5 percent by weight based on the total weight of the solution of polyester adhesive (duPont 49,000, available form E. I. duPont de Nemours & Co.) in a 70.30 volume ratio mixture of tetrahydrofuran/cyclohexanone. The adhesive interface layer was allowed to dry for 5 minutes at 135° C. in the forced air oven. The resulting adhesive interface layer had a dry thickness of 0.065 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mls of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). However, a strip about 3 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in the forced air over to form a dry thickness photogenerating layer having a thickness of 2.0 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)- 1,1'-biphenyl-4,4'-diamine and Makrolon 5705, a polycarbonate resin having a molecular weight of from about 50,000 to 100,000 commercially available from Farbensabricken Bayer A.G. The resulting mixture was dissolved to give a 15 percent by weight solid in 85 percent by weight methylene chloride. This solution was applied onto the photogenerator layer to form a coating which upon drying had a thickness of 24 micrometers.

The approximately 3 mm wide strip of about of the adhesive layer left uncoated by the photogenerator layer was coated with a ground strip layer during the co-coating process. This ground strip layer had a dried thickness of about 14 micrometers. This ground strip is electrically grounded, by conventional means such as a carbon brush contact means during conventional xerographic imaging.

The resulting imaging member web containing all of the above layers was annealed at 135° C. in the forced air oven for 5 minutes.

An anti-curl coating was prepared by combining 8.82 grams of polycarbonate resin (Makrolon 5705, available from Bayer AG), 0.09 gm of polyester resin (Vitel PE-100, available from Goodyear Tire and Rubber Company) and 90.1 grams of methylene chloride in a glass container to form a coating solution containing 8.9 percent solids. The container was covered tightly and placed on a roll mill for about 24 hours until the polycarbonate and polyester were dissolved in the methylene chloride to form the anti-curl coating solution. The anti-curl coating solution was then applied to the rear surface (side opposite the photogenerator layer and charge transport layer) of the imaging member with a 3 mil gap Bird applicator and dried at 135° C. for about 5 minutes in the forced air oven to produce a dried film thickness of about 13.5 micrometers. The resulting electrophotographic imaging member had a structure similar to that schematically shown in FIG. 4 and was used as an imaging member control.

EXAMPLE II

This Example deals with master coating solutions preparation for gamma aminopropyltriethoxy silane, poly(2-hydroxyethyl methacrylate), and hydroxypropylcelluose. A 4 percent by weight organoaminosilane master solution was prepared by mixing 4 grams of the silane (available from Union Carbide Corporation), 16 grams of distilled water, and 1.2 grams of acetic acid in a container. The mixture was allowed to stand for 10 minutes with constant agitation to complete the hydrolysis reaction. The mixture was then diluted with 78.8 grams of Dowanol® PM (1-methoxy-2-hydroxypropane, available from Dow Chemical Company) to form a 4 percent by weight of hydrolyzed silane master solution. A 4 percent by weight master solution was also prepared by dissolving 8 grams of poly(2-hydroxyethyl methacrylate) (available from Scientific Polymer Products, and having a weight average molecular weight of $1.2\times10^6$) in 192 grams of Dowanol®, and likewise for the preparation of a 4 percent by weight hydroxypropylcelluose (available from Hercules Incorporated, and having a weight average molecule weight of $6\times10^4$) master solution.

The reason that poly(2-hydroxyethyl methacrylate) and hydroxypropylcelluose are selected for present invention application is due to the fact that they are film forming polymers, are soluble in polar solvent, and are by themselves good hole blocking materials. Having abundant hydroxy functional pendant groups in their polymer structures, they can easily be co-crosslinked into a three dimensional network structure with the organoaminosilane through the heating/drying processes. The excess hydroxy groups are also highly efficient in prevent hole injection from the ground plane during electrophotographic imaging operations.

EXAMPLE III

An electrophotographic imaging member was fabricated according to the description of Example I, except that the application of an organoaminosilane layer was replaced by the hole blocking layer of this invention which was coated from a 4 percent by weight solution prepared by mixing 10 grams of the hydrolyzed gamma aminopropyltriethoxy silane master solution and 90 grams of the poly(2-hydroxyethyl methacrylate) master solution of Example II plus addition of 0.04 gram of alphazurine A dye (a cyan color biological staining agent available from Allied Chemicals) to form a hole blocking solution. The applied gamma aminopropyltriethoxy silane/poly(2-hydroxyethyl methacrylate)/dye wet coating, using a 1½ mil gap Bird applicator, over the titanium/polyester substrate was dried at 135° C. for 5 minutes in the forced air oven to yield a 1.5 micrometers dry hole blocking layer thickness containing 9.5 percent gamma aminopropyltriethoxy silane, 89.5 percent poly(2-hydroxyethyl methacrylate), and 1 percent by weight cyan dye.

EXAMPLE IV

An electrophotographic imaging member was fabricated by following the same procedures and using the same materials as described in Example III, except that the dye content in the dried hole blocking layer was 10 percent by weight.

EXAMPLE V

An electrophotographic imaging member was fabricated according to the description of Example III, except that the poly(2-hydroxyethyl methacrylate) in the hole blocking layer of this invention was substituted by hydroxypropylcelluose.

EXAMPLE VI

An electrophotographic imaging member was fabricated by following the same procedures and using the same materials as described in Example V, except that the dye content in the hole blocking layer of this invention was 10 percent by weight.

EXAMPLE VII

An electrophotographic imaging member was fabricated according to the description of Example III, except that the hole blocking layer of this invention had a dry thickness of 1.6 micrometers and contained 9 percent gamma aminopropyltriethoxy silane, 40.5 percent Poly(2-hydroxyethyl methacrylate), methacrylate), 40.5 percent hydroxypropylcelluose, and 10 percent by weight dye.

EXAMPLE VIII

An electrophotographic imaging member was fabricated by following the procedures and using the same materials as described in Example IV, except that the coating of an integral 49,000 interface adhesive layer was omitted, but a 10 percent by weight 49,000 polyester was blended into the charge generating layer to promote adhesion.

EXAMPLE IX

An electrophotographic imaging member was fabricated as described in Example VIII, except that a 0.05 micrometer gamma aminopropyltriethoxy silane layer was first coated over the titanium/polyester substrate, according to the procedures described in Example I, prior to the application of the hole blocking layer of this invention which contained a 1 percent by weight dye in its matrix. This imaging member is distinctively different from all the imaging members described above because it had a dual-hole blocking layer.

EXAMPLE X

An electrophotographic imaging member having a dual-hole blocking layer was fabricated by following the procedures and using the same material as described in Example IX, except the dye content in the blocking layer of this invention was 15%.

EXAMPLE XI

A titanium/3-mil polyester substrate was overcoated with a 1.5 micrometer thick hole blocking layer of this invention which contained 9.5 percent gamma aminopropyltriethoxy silane, 89.5 percent Poly(2-hydroxyethyl methacrylate), and 10 percent by weight alphazurine A cyan dye by following the procedures described for hole blocking layer coating in Example IV. When examined under a coherent light emitted from a low pressure sodium lamp source, the original blue appearance of the hole blocking layer immediately turned black, indicating effective light energy absorption by the dye to totally eliminate the surface reflection from the metallic substrate.

EXAMPLE XII

To evaluate the effectiveness of the cyan dye in the blocking layer of this invention in suppressing the formation of plywood fringes during image development, the electrophotographic imaging members of Examples I, III through X were carefully examined under the coherent light source. In sharp contrast to the wood grain patterns observed in the control imaging member of Example I, the wood grain fringes were significantly suppressed for the imaging members of Example III, V and IX containing only 1 percent by weight of the cyan dye in the hole blocking layer of this invention. Moreover, total absence of wood grain fringes were noted for all other imaging members of Examples IV, VI, VII, VIII and X having a higher cyan dye content of 10 and 11 percent by weight.

When tested for photoelectrical properties using a xerographic scanner, the imaging members containing the blocking layers of the present invention gave good charging/discharging, good field induced dark decay electrical characteristic, and 10,000 cycles of electrical stability equivalent to the results obtained for the control imaging member counterpart of Example I.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate, a hole blocking layer, an optional interface adhesive layer, a charge generating layer, and a charge transport layer, said blocking layer comprising a light absorbing material selected from the group consisting of a dye, pigment and mixtures thereof dissolved or dispersed in a hole blocking matrix comprising a film forming polymer, said light absorbing material being capable of absorbing incident radiation having a wavelength between about 550 and about 950 nm.

2. An electrophotographic imaging member according to claim 1 wherein said blocking matrix also comprises a reaction product of an organoaminosilane.

3. An electrophotographic imaging member according to claim 2 wherein said organoaminosilane is a hydrolyzable organoaminosilane represented by the following formula:

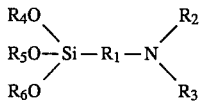

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms.

4. An electrophotographic imaging member according to claim 1 wherein said hole blocking layer is in contiguous contact with said charge generating layer.

5. An electrophotographic imaging member according to claim 1 wherein said light absorbing material is a violet, blue, green, cyan or black dye dissolved in said film forming polymer.

6. An electrophotographic imaging member according to claim 1 wherein said light absorbing material is a violet, blue, green, cyan or black pigment uniformly dispersed in said film forming polymer.

7. An electrophotographic imaging member according to claim 1 wherein said blocking layer comprises between about 1 percent and 30 weight percent of said light absorbing material based upon the total weight of the dried blocking layer.

8. An electrophotographic imaging member according to claim 1 wherein said blocking layer comprises between about 3 percent and 20 weight percent of said light absorbing material based upon the total weight of the dried blocking layer.

9. An electrophotographic imaging member according to claim 1 wherein said blocking layer has a thickness between about 0.5 micrometer and about 5 micrometers.

10. An electrophotographic imaging member according to claim 1 wherein said blocking layer has a thickness between about 1 micrometer and about 3 micrometers.

11. An electrophotographic imaging member according to claim 1 wherein said blocking layer has an electrical resistivity between about $10^3$ ohm-cm and and about $10^{12}$ ohm-cm.

12. An electrophotographic imaging member according to claim 1 wherein said blocking layer has an electrical resistivity between about $10^7$ ohm-cm to about $10^{10}$ ohm-cm.

13. An electrophotographic imaging member according to claim 1 wherein said blocking layer overlies another blocking layer.

14. An electrophotographic imaging process comprising providing an electrophotographic imaging member comprising a substrate, a hole blocking, an optional interface adhesive layer, a charge generating layer, and a charge transport layer, said hole blocking layer comprising a light absorbing material selected from the group consisting of a dye, pigment and mixtures thereof dissolved or dispersed in a film forming polymer, said light absorbing material being capable of absorbing incident radiation having a wavelength between about 550 and about 950 nm, charging said imaging member to a uniform electrostatic charge on said imaging member, exposing said imaging member with monochromatic activating radiation having a wavelength between about 600 and about 800 nm to form an electrostatic latent image on said imaging member, developing said latent image with toner particles to form a toner image corresponding to said latent image, and transfering said toner image to a receiving member.

15. An electrophotographic imaging process according to claim 14 wherein said blocking matrix also comprises a reaction product of an organoaminosilane.

16. An electrophotographic imaging process according to claim wherein said light absorbing material is a violet, blue, green, cyan or black dye dissolved in said film forming polymer.

17. An electrophotographic imaging process according to claim 14 wherein said light absorbing material is a violet, blue, green, cyan or black pigment uniformly dispersed in said film forming polymer.

18. An electrophotographic imaging process according to claim 14 wherein said blocking layer comprises between about 1 percent and 30 weight percent of said light absorbing material based upon the total weight of the dried blocking layer.

19. An electrophotographic imaging process according to claim wherein said blocking layer has an electrical resistivity between about $10^3$ ohm-cm and and about $10^{12}$ ohm-cm.

20. An electrophotographic imaging process according to claim wherein said blocking layer overlies another blocking layer.

* * * * *